United States Patent [19]

Keller

[11] Patent Number: 4,638,932

[45] Date of Patent: Jan. 27, 1987

[54] COMBINATION TOOL TO PULL UP AND REMOVE SOCKS, SHORTS AND TROUSERS

[76] Inventor: Henry C. Keller, 930 E. Lake St., Aurora, Ill. 60506

[21] Appl. No.: 677,963

[22] Filed: Dec. 4, 1984

[51] Int. Cl.[4] ..... A47G 25/80

[52] U.S. Cl. ..... 223/111; 223/113

[58] Field of Search ..... 223/112, 111, 113; 24/537

[56] References Cited

U.S. PATENT DOCUMENTS

| | | | |
|---|---|---|---|
| 892,162 | 6/1908 | Kennedy | 24/537 |
| 1,116,797 | 11/1914 | Carmichael et al. | 223/113 |
| 1,307,129 | 6/1918 | Karadaghli | 24/537 |
| 1,446,344 | 2/1923 | Graydon | 24/537 |
| 4,238,865 | 12/1980 | Ingemann et al. | 24/537 |

FOREIGN PATENT DOCUMENTS

| | | | |
|---|---|---|---|
| 1079238 | 6/1980 | Canada | 223/112 |
| 812069 | 4/1937 | France | 24/537 |

*Primary Examiner*—Louis K. Rimrodt
*Assistant Examiner*—Joseph S. Machuga
*Attorney, Agent, or Firm*—Ernest Kellelson

[57] ABSTRACT

A combination tool to pull up socks, shorts and trousers for those who have difficulty in bending over, comprising a tong-like member having a pair of elongated arms extending from a handle end to a gripping end. The arms are integrally joined at the handle end in a U-bend, are of spring steel or other material which is relatively rigid but which can be flexed and will spring back to an original position when released, the arms extend parallel in close side-by-side relationship to the gripping end, and resilient protective pads are provided at the gripping end of each arm to hold a sock or other item of clothing between the protective pads.

6 Claims, 5 Drawing Figures

COMBINATION TOOL TO PULL UP AND REMOVE SOCKS, SHORTS AND TROUSERS

BACKGROUND OF THE INVENTION

This invention relates to the field of devices to aid handicapped persons and others who have difficulty in bending over in putting on as well as taking off of socks and other articles of clothing.

Prior art devices of this kind include such things as a sock expanding frame and control bar with a spreading device to spread the sock apart as shown in U.S. Pat. No. 4,284,216; a U-shaped form at the end of a pair of handle bars to also spread the sock apart and hold it open while being drawn on to one's foot as disclosed in U.S. Pat. No. 3,853,252; another U-shaped device in the form of a clamp to hold the sock opening apart and gripped while being drawn on to the foot as disclosed in U.S. Pat. No. 3,604,604, a frame for expanding the opening of socks or stockings with garter snaps to hold them as they are pulled on as shown in U.S. Pat. No. 3,231,160; a closed hoop or ring with fasteners to hold the sock opening apart for pulling on to the foot, with handles connected to the hoop as shown in U.S. Pat. No. 3,070,271; a spring biased clamping device having spaced apart clamps to grip the sock opening and hold it spread apart for insertion of one's foot, a link member holding the clamp members apart, and chains to pull the clamps open against the bias of the spring to release the sock as shown in U.S. Pat. No. 2,919,840; another U-shaped clamp disclosed in U.S. Pat. No. 2,903,170 is very similar to the one in U.S. Pat. No. 3,604,604 and by the same inventor; and another hoop or ring type of sock puller having a pair of opposed clamps to grip opposite sides of a sock and hold them apart, the clamps manipulated between open and closed positions by a pair of levers as shown in U.S. Pat. No. 1,315,096.

All of these prior art devices include means to spread the opening of the socks and stockings apart, most having clamps or other fastening devices associated with the U-shaped frames or hoops used to spread the sock openings apart, and a few relying on the frictional force of the spread apart frame to hold the sock as it is pulled on. Connecting the clamps and fastening devices of such prior art devices to opposite sides of a sock or stocking opening can be a time consuming and awkward task, particularly for the infirm. The same is true for those prior art devices which require spreading the sock apart under enough tension that the sock will stay on the frame while being pulled on. It requires some force to spread a frame member apart sufficiently to stretch the sock or stocking to the point it will not pull away from the the frame as the sock or stocking is pulled on the user's foot. It also requires some dexterity to manipulate the complicated assembly of levers and spreading devices shown on the prior art devices, a level of dexterity that the infirm and handicapped persons may not have.

The tool in accordance with the present invention overcomes such problems, and provides a more natural mechanical extension of one's hands to grip and pull on, not only socks but other items of clothing as well, and not only to pull them on but to take them off as well. One of the tools in accordance with the present invention can be held in each hand, and readily moved apart as well as together throughout the entire range of the user's own arms to whatever distance necessary for gripping a sock in one instance, farther apart to grip the opposite sides of a pair of shorts in another instance, or trousers, and the like. The invention in this case does not require a limiting spacer device, or spreader device, which all of the prior art attempts to deal with this problem require. Thus, the prior art devices can only be used for the particular item of clothing they are designed for, specifically socks or stockings. There is no way the prior art defices could be used to pull on other items of clothing such as shorts and trousers. Neither can they be used to help in removing the socks or stockings, since it would be more hindrance than help to try to reposition the hoops, U-frames, and spread-apart type frames around a person's leg, then try to refasten the snaps or clamps to the edges of the stocking, and then push the stocking off.

By discovering that the tools do not have to be mechanically held or linked together in order to perform the function of helping handicapped persons who cannot bend over pull on their socks or also be used to help pull on other clothing as well, and in addition to provide real help in removing not only socks and stockings but other clothing as well.

The tool in accordance with the present invention comprises a tong-like member having a pair of elongated arms of spring steel, or other similar material, integrally joined in a U-bend at the handle end and terminating in free ends at the gripping end, with broad surface protective pads on such free ends, the arms being in close side-by-side relationship, the free ends being normally spaced apart slightly, just enough to receive the edge of a sock or other item of clothing between the pads. The length of the arms of the tool is sufficient for the gripping end to reach the end of the user's toes when the handle end is held in the user's hand and the user is not bent over. The slightly spead apart gripping end of one tool is slipped over one edge of the sock opening, and an elongated tubular slide member through which the tool arms extend is moved down toward the gripping end forcing the pads together gripping the sock edge between. The same is done with the tool held in the other hand of the user to grip the opposite edge of the sock opening. The sock at the gripping end of the elongated tool can then be positioned in front of the toes of the user without having to bend, whereupon it can be drawn on to the foot of the user. To remove the sock, the protective gripping pads can easily be slipped over the edges of the sock opening and downward thereof, with the pads on the inside of the sock being able to slide between the user's leg and the inside of the sock to a more convenient location for pushing the sock off, then clamping the pads of each tool together and then pushing the sock off.

SUMMARY OF THE INVENTION

It is an object of the invention to provide a tool to pull on and remove socks and other articles of clothing without the user having to bend over.

It is an object of the invention to provide a tool to pull on and remove socks and other articles of clothing, comprising a pair of elongated arms joined at the handle end and having jaw members at the gripping end to grip the edge of an article of clothing, and an operating member to move said jaw members into gripping position, said operating member movable between a jaw gripping position and a jaw released position.

It is an object of the invention to provide a tool to pull on socks without the user having to bend over which can also be used to pull on trousers and other articles of clothing, and which can also be used to remove socks, trousers and other articles of clothing without the user having to bend over.

DESCRIPTION OF PREFERRED EMBODIMENT

Figure 1:
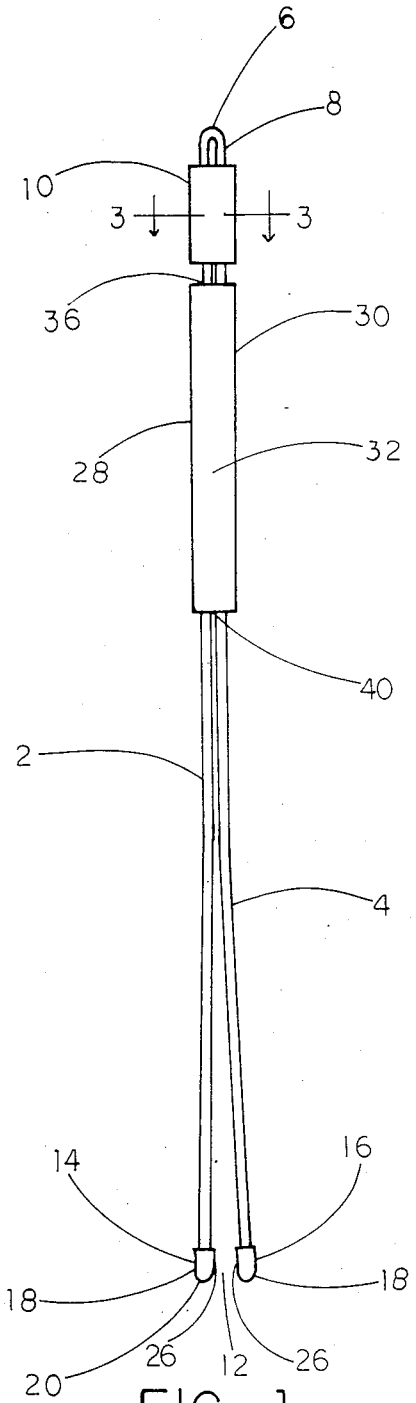
FIG. 1 is an elevation view of a tool in accordance with this invention for pulling on and removing articles of clothing showing the jaw members in the normally slightly spread apart position, and the operating member shown in the jaw released position.
Figure 2:
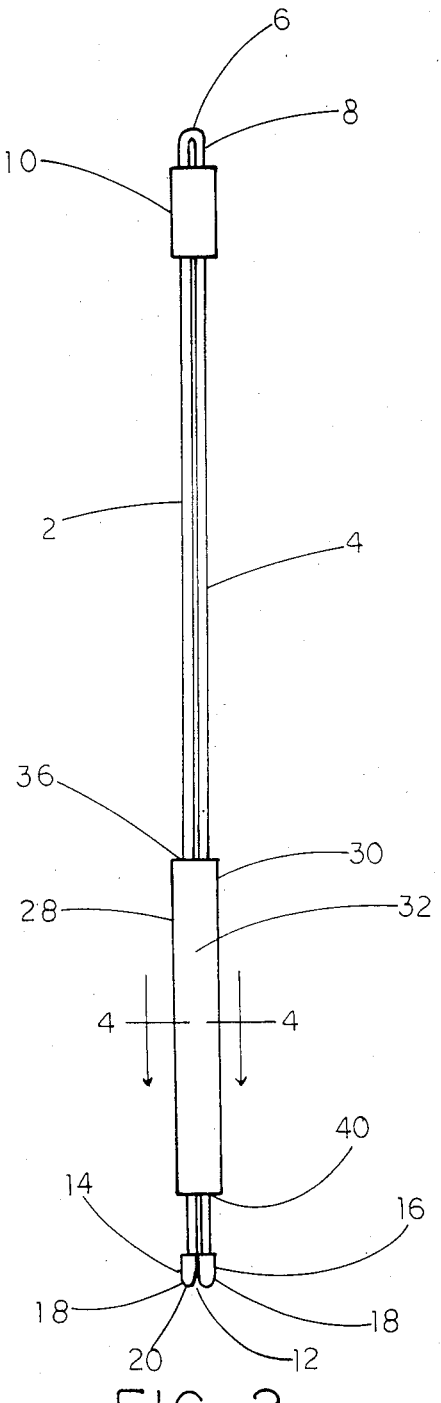
FIG. 2 is an elevation view of the tool shown in FIG. 1, with the operating member shown moved to the jaw gripping position, and the jaw members in the closed gripping position.
Figure 3:
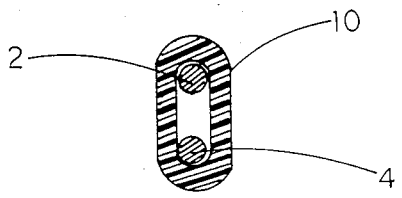
FIG. 3 is a section view taken on line 3—3 of FIG. 1.
Figure 4:
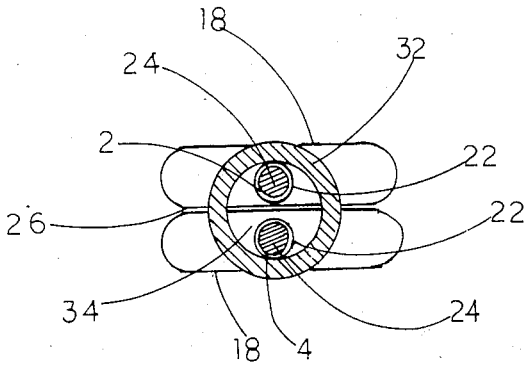
FIG. 4 is a section view taken on line 4—4 of FIG. 2.

A tool for helping to pull on and remove socks or other articles of clothing in accordance with this invention includes a pair of elongated arms 2 and 4, of spring steel or other similar material which is relatively rigid but which can be flexed from an original position and when released will return to such original position.

The elongated arms 2 and 4 are integrally joined in a U-bend 6, at the handle end 8. A hand grasp 10 of a resilient material is fitted over and around the arms 2 and 4 adjacent the handle end 8 for the user to conveniently grasp the tool in his hand. The elongated arms 2 and 4 extend in side-by-side relation from the handle end 8 to the gripping end 12 of the tool.

The gripping end 12 includes a pair of jaw members 14 and 16, comprising resilient pads 18 of rubber, or soft resilient plastic material, fabric or the like which provides a cushioned protective surface to bear against articles of clothing gripped between the jaw members 14 and 16 and which increases the frictional gripping force of the jaw members 14 and 16 on the articles of clothing held therebetween. The resilient pads 18 are preferably tapered at their tip end 20 to facilitate slipping the jaw members 14 and 16 past the edge of an article of clothing to position them for gripping the article of clothing therebetween. The resilient pads 18 include a cylindrical cavity 22 to receive the free end portions 24 of the elongated arms 2 and 4 therein in a tight frictional fit.

The resilient pads 18 include relatively broad surface side walls 26 to provide increased gripping surface area when the side walls 26 of the pads 18 of jaw members 14 and 16 are brought together in gripping relationship.

The jaw members 14 and 16 are in a normally slightly open position, the elongated arms 2 and 4 being bowed outwardly from each other to a slight degree as they extend from the handle end 8 toward the gripping end 12, when the operating member 28 is in its jaw released position adjacent the hand grasp 10 at the handle end 8 of the tool. The jaw members 14 and 16 are moved to the closed or gripping position by sliding the operating member 28 toward the gripping end 12 of the tool. The operating member 28 comprises an elongated tubular length 30 of rigid metal or plastic material, having an elongated cylindrical peripheral wall 32 surrounding an elongated cylindrical bore 34.

The elongated arms 2 and 4 of the tool are received through the cylindrical bore 34 of operating member 28. The cylindrical bore 34 is large enough to enable the operating member 28 to slide along the elongated arms 2 and 4 from the handle end 8 toward the gripping end 12, drawing the outwardly bowed arms 2 and 4 together as the operating member 28 moves toward the gripping end, until the side walls 26 of the pads 18 of jaw members 14 and 16 begin to come together. The operating member can then be moved farther in the direction toward the gripping end 12 to compress the side walls 26 of pads 18 of jaw members 14 and 16 against each other for tighter gripping engagement of an article of clothing therebetween. Thus, the cross-sectional dimension of the cylindrical bore 34 of the operating member 28 in relation to that of the elongated arms 2 and 4 and of the side walls 26 of pads 18 may be stated as follows. The diameter of the cylindrical bore 34 is equal to the diameter of elongated arm 2 of cylindrical cross-section, plus the diameter of elongated arm 4 of cylindrical cross-section, plus an additional distance defined as any distance between (1) zero and (2) that distance which is equal to the thickness of two side walls 26 of resilient pads 18. If the diameter of the cylindrical bore 34 of operating member 28 were any larger than the diameters of arms 2 and 4 plus the thickness of two side walls 26 of pads 18, the operating member 28 could not draw the pads 18 of jaw members 14 and 16 together into gripping relationship.

The elongated arms 2 and 4 are long enough for the gripping end 12 to reach the end of the user's toes when the handle end 8 is held in his hand with arm extended but without the user being bent over. A convenient length for use by adults of average height is approximately twenty inches from the handle end 8 to the gripping end 12.

The length of the elongated tubular operating member 28 may vary, but it should be long enough to provide good contact surface area of its inner cylindrical wall with the arms 2 and 4 over a sufficient length to hold the jaw members 14 and 16 and their pads 18 together securely when in the gripping position. Also, it is desirable for the user to be able to easily reach the upper end 36 of operating member 28 which is nearest the handle end 8 of the tool when the operating member 28 is in its jaw closed position with its lower end 40 approaching the jaw member 14 and 16. Thus, a preferred length of the elongated operating member 28 in relation to the length of the arms 2 and 4 may be defined as between one-fourth and one-third of the length of arms 2 and 4. By way of example, for a tool in which arms 2 and 4 are twenty inches long, the operating member 28 should preferably be between five and six inches in length.

Figure 5:
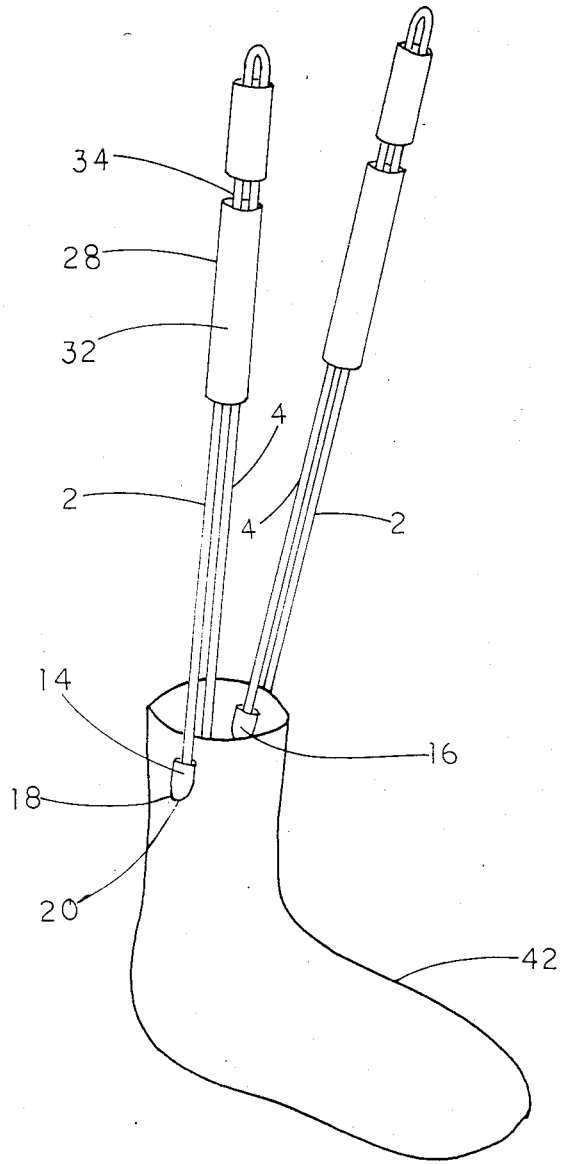
FIG. 5 is a perspective view of a pair of tools in accordance with this invention shown in position to grip opposite side edges of the opening of a sock.

To use the tool in accordance with this invention, the user takes one tool in his right hand with the operating member 28 in the jaw released position whereby the jaw members 14 and 16 are slightly spread apart to receive the edge of a sock 42 for example on the right hand side the sock opening. The operating member 28 is then pushed downwardly toward the gripping end 12 until the pads 18 of jaw members 14 and 16 securely grip the edge of the sock on the right side. A second tool is applied to the left hand side of the sock opening in the same manner as shown in FIG. 5, and its operating member 28 pushed downwardly toward the gripping end 12 until the pads 18 of its jaw members 14 and 16 securely grip the edge of the sock on the left side.

The tool secured to the right hand side of the sock opening is taken in the right hand of the user, the tool secured to the left hand side of the sock opening is taken in the left hand of the user, he extends his arms without bending over and positions the sock opening in front of the toes of one of his feet and then pulls the sock on to his foot. If necessary, such as in the case of long stockings which pull up as far as the knee or the thigh wherein pulling on the upper edge of the stocking alone may result in tearing because of the additional force needed as more of the stocking is pulled over the foot and the leg, the jaw members 14 and 16 of each tool may be released and moved downwardly farther into the stocking for a new grip.

When the tool is used to remove socks or other articles of clothing, the tapered pads 18 of jaw members 14 and 16 of one arm 2 or 4 are readily inserted between the users leg or other body portion and the article of clothing, while the other pad 18 of the other jaw member goes on the outside of the article of clothing. The jaw members 14 and 16 are then closed by moving the operating member 28 to the jaw closed position, whereupon the user can then push the article of clothing downwardly until it clears the end of his foot or feet. Again, it is possible to push the gripping end 12 of the tool in accordance with this invention down into the sock or other item of clothing far beyond its opening, in order to start the process of removing the article of clothing from the user's body. In the case of socks and stockings for example, it is often necessary to apply pressure to a portion thereof midway between its opening end and its toe end, or nearer its toe end, in order to remove the sock or stocking without damage. The tool in accordance with this invention is able to accomplish that without requiring the user to have to bend over, by virtue of its unique construction.

While two tools as described and shown herein may be conveniently used to help in putting on and taking off of articles of clothing, one in each hand of the user, only one of such tools may be used to also accomplish the result. A single tool may be alternately applied to opposite sides of the sock opening, or opening of other articles of clothing, to move the clothing item partially on or off on one side, then doing the same on the other side, and continuing until the clothing items is completely on or completely off.

I claim:

1. A tool to help in putting on and removing an article of clothing comprising elongated extension means to enable a user to reach beyond the end of his toes therewith without bending, said elongated extension means comprising a pair of elongated arms of circular cross section disposed in a side by side flexible, spring-like relationship and where one of said arms diverge slightly from the other, said elongated arms are at least 20 inches in length and are integrally joined at one end in a U-bend, jaw means at the other end of said elongated arms, said jaw means are adapted to receive and grasp a single edge portion of an article of clothing, said jaw means being movable between a jaws open position and a jaws closed position, handle means attached to said integral end of said elongated arms, said extension means further comprises operating means to manually operate said jaws means between said jaws open position and said jaws closed position, said operating means comprising and elongated rigid cylindrical member having an elongated cylindrical bore therein adapted to surround said elongated arms, said operating means being manually movable between a first position where the jaws are in the said open position and a second position where the jaws are in the said closed position, and wherein said operating means is adapted to move said jaw means into tighter gripping engagement the further said operating means is manually moved in the jaws closing direction, said jaw means having a first and second gripping means, each of said gripping means comprising a pad of resilient cushioning material, said resilient cushioning material comprising a body member having a top wall, bottom wall, broad side surfaces, a recess in said top wall to receive one of said elongated arms and a tapered portion converging toward said bottom wall.

2. A tool to help in putting on and removing an article of clothing as set forth in claim 1, wherein said elongated rigid cylindrical member is at least five inches in length.

3. A tool to help in putting on and removing an article of clothing as set forth in claim 1, wherein said elongated arms integrally joined at said handle end are constructed of steel.

4. A tool to help in putting on and removing an article of clothing as set forth in claim 1, including a second said tool, said jaw means of said first mentioned tool grasping a single edge portion of an article of clothing on one side thereof, said jaw means of said second said tool grasping a single edge portion of an article of clothing on the opposite side thereof, said first mentioned tool being held in one hand of a said user, said second said tool being held in the other hand of a said user, whereby said article of clothing may be held beyond the end of the said toes of a said user without his bending.

5. A tool to help in putting on and removing an article of clothing as set forth in claim 1, wherein said rigid cylindrical member of said operating means is any length between one-fourth and one-third of the length of said elongated arms to provide sufficient clamping force on said jaw members to tightly grip even thin items such as cloth therebetween when said rigid cylindrical member is moved to said jaws closed position and to provide the additional leverage such as elongated member of said relative length is able to provide whereby a handicapped person of less strength is more easily able to slide it into a sufficiently tight grip to hold the edge of an article of clothing he is attempting to put on or take off.

6. A tool to help in putting on and removing an article of clothing as set forth in claim 1 wherein the diameter of said cylindrical bore being any size within the range of that which is equal to the combined diameters of said elongated arms plus any additional distance between zero and that which is equal to said pre-determined thickness of two of said pads to provide a tighter clamping engagement of one jaw member against the other the farther said operating member is moved manually in the jaws closing direction.

* * * * *